US006186075B1

(12) United States Patent
Spencer

(10) Patent No.: US 6,186,075 B1
(45) Date of Patent: Feb. 13, 2001

(54) SIDE FRAME-BOLSTER INTERFACE FOR RAILCAR TRUCK ASSEMBLY

(75) Inventor: Charles P. Spencer, Aurora, IL (US)

(73) Assignee: Amsted Industries Incorporated, Chicago, IL (US)

( * ) Notice: Under 35 U.S.C. 154(b), the term of this patent shall be extended for 0 days.

(21) Appl. No.: 09/137,021

(22) Filed: Aug. 20, 1998

(51) Int. Cl.[7] ..... B61F 3/00
(52) U.S. Cl. ..... 105/206.1; 105/200
(58) Field of Search ..... 105/182.1, 200, 105/206.1, 207; 213/11

(56) References Cited

U.S. PATENT DOCUMENTS

| | | | |
|---|---|---|---|
| 2,192,171 | 3/1940 | Akitt | 105/207 |
| 2,199,360 | 4/1940 | Light | 105/207 |
| 2,200,571 | 5/1940 | Barrows | 105/207 |
| 2,220,218 | 11/1940 | Cottrell | 105/207 |
| 2,378,415 | 6/1945 | Light | 105/197 |
| 2,407,950 | 9/1946 | Cottrell | 105/197 |
| 2,422,201 | 6/1947 | Lehrman | 105/197 |
| 2,597,909 | 5/1952 | Tack | 105/197 |
| 2,709,971 | 6/1955 | Rossell | 105/197 |
| 2,911,923 | 11/1959 | Bachman et al. | 105/198.2 |
| 3,339,498 | 9/1967 | Weber | 105/207 |
| 3,408,955 | 11/1968 | Barber | 105/197 |
| 3,901,163 | 8/1975 | Neumann | 105/197 DB |
| 4,084,513 | 4/1978 | Bullock | 105/197 DB |
| 4,276,833 | 7/1981 | Bullock | 105/197 DB |
| 4,357,880 | 11/1982 | Weber | 105/206 R |
| 4,370,933 | 2/1983 | Mulcahy | 105/197 DB |
| 4,440,095 | 4/1984 | Mathieu | 105/207 |
| 4,491,075 | 1/1985 | Neumann | 105/207 |
| 5,072,673 | 12/1991 | Lienard | 105/198.2 |
| 5,331,902 | 7/1994 | Hawthorne et al. | 105/198.2 |
| 5,417,163 | 5/1995 | Lienard | 105/198.7 |
| 5,921,186 * | 7/1999 | Hawthrone et al. | 105/207 |

FOREIGN PATENT DOCUMENTS

WO 92 2055 11/1992 (WO) ..... B61F/5/12

OTHER PUBLICATIONS

ASME Paper 79–WA/RT–14, "Truck Hunting in Three–Piece Freight Car Truck".

Association of America Railroad Standard S–318—78, p. D–119 in the Manual of Standards and Recommended Practices.

Manual of Standards and Recommended Practices of the Association of America Railroads, p. D–ii–200.25.

"Final Report Testing, Evaluation and Recommendations Curving Performance of 125T DS Cars" by Rail Sciences, Inc., Atlanta, Georgia, Feb. 12, 1993.

U.S. Patent Appln. No. 08/850,178; Filed on May 2, 1997; identified as AMSTED Case No. 6159; pp. 1–19; including FIGS. 1–17.

* cited by examiner

*Primary Examiner*—S. Joseph Morano
*Assistant Examiner*—Robert J. McCarry, Jr.
(74) *Attorney, Agent, or Firm*—Edward J. Brosius; Stephen J. Manich

(57) ABSTRACT

A three-piece railcar truck assembly is disclosed. The truck assembly has two side frames and a bolster extending between the side frames. Each side frame has spaced columns defining an opening which receives one end of the bolster. Each side frame also has forward and rearward lugs at the columns, both on the inboard side and the outboard side. Each side frame lug has a stop surface that is aligned in a facing relationship with a stop surface of one bolster gib. There is a gap between the opposed side frame lug and bolster gib stop surfaces. The gap distance is limited to limit the truck warp angle. The neighboring side frame lugs and bolster gibs may be sized, shaped and spaced so that the truck warp angle may be limited to an angle of less than two degrees.

16 Claims, 7 Drawing Sheets

SIDE FRAME-BOLSTER INTERFACE FOR RAILCAR TRUCK ASSEMBLY

BACKGROUND OF THE INVENTION

The present invention relates to railcar truck assemblies and more specifically to squaring of three-piece railcar truck assemblies.

In previous railcar truck assemblies, wide laterally-extending stop surfaces or lands adjacent to the side frame wear plates and bolster friction shoe pockets have been provided to avoid rotation of the bolster about its longitudinal axis, that is, bolster rotation. Alternatively, bolster rotation stop lugs have been provided at the inboard face of a side frame column to inhibit rotation of the bolster in the side frame about the bolster's longitudinal axis. Such rotation about the bolster's longitudinal axis is known as pitching.

The bolster may also rotate about a vertical axis. Such rotation of the bolster is known as warping or lozenging. When the truck warps, it is unsquare: the side frames operationally remain parallel to each other, but one side frame moves slightly ahead of the other in a cyclic fashion. In truck warping, the bolster rotates about its central vertical axis, causing angular displacement of the side frame and bolster longitudinal axes from a normal relationship. Warping results in wheel misalignment with respect to the track. It is more pronounced in curved track and usually provides the opportunity for a large angle-of-attack to occur. Warping can lead to railcar truck hunting, that is, a continuous instability of a railcar wheel set wherein the truck weaves down the track in an oscillatory fashion, usually with the wheel flanges striking against the rail.

To reduce truck warping, U.S. patent application Ser. No. 08/950,178, filed on May 2, 1997 and entitled "Improved Bolster Land Arrangement for Railcar Truck", discloses that the free travel between the mated bolster and side frames at the side frame columns may be constrained. The clearance or separation gap between the bolster lands and the side frame columns is reduced.

However, in some environments, it may be desirable to avoid using a tight clearance between the bolster lands and side frame columns to reduce warping. For example, in some environments, it may be desirable to provide closely-spaced surfaces to reduce warping that can be more easily inspected for wear than at the bolster lands, or it may be desirable to provide design alternatives to closely-spaced surfaces at the bolster and side frame lands.

SUMMARY OF THE INVENTION

The present invention provides a railcar truck assembly that controls truck warping through constraint of the free travel between the mated bolster and side frames.

BRIEF DESCRIPTION OF THE DRAWINGS

In the figures of the Drawings, like reference numerals identify like components and.

DETAILED DESCRIPTION

Figure 1:
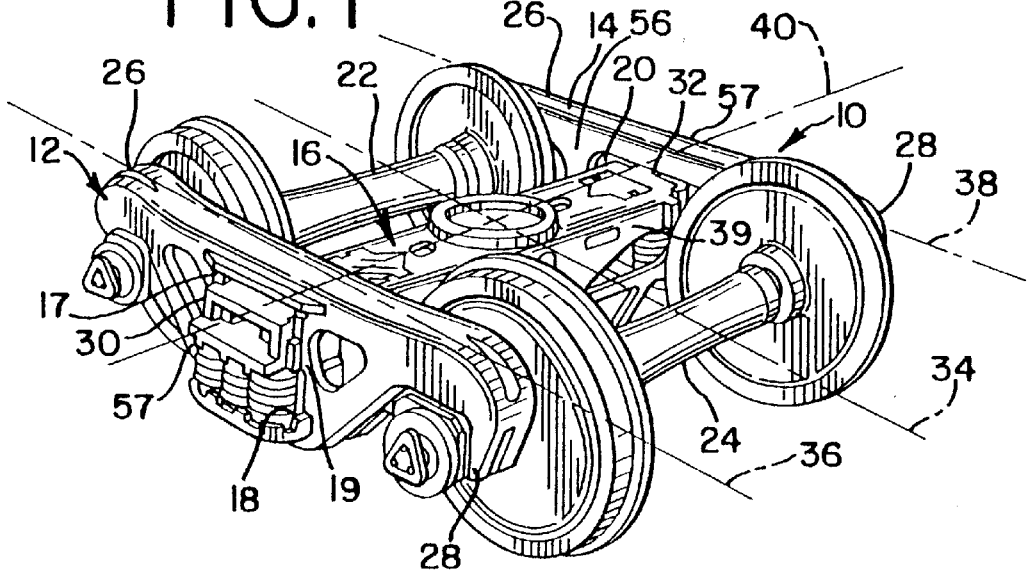
FIG. 1 is an oblique view of a representative three-piece railcar truck assembly.
Figure 4:
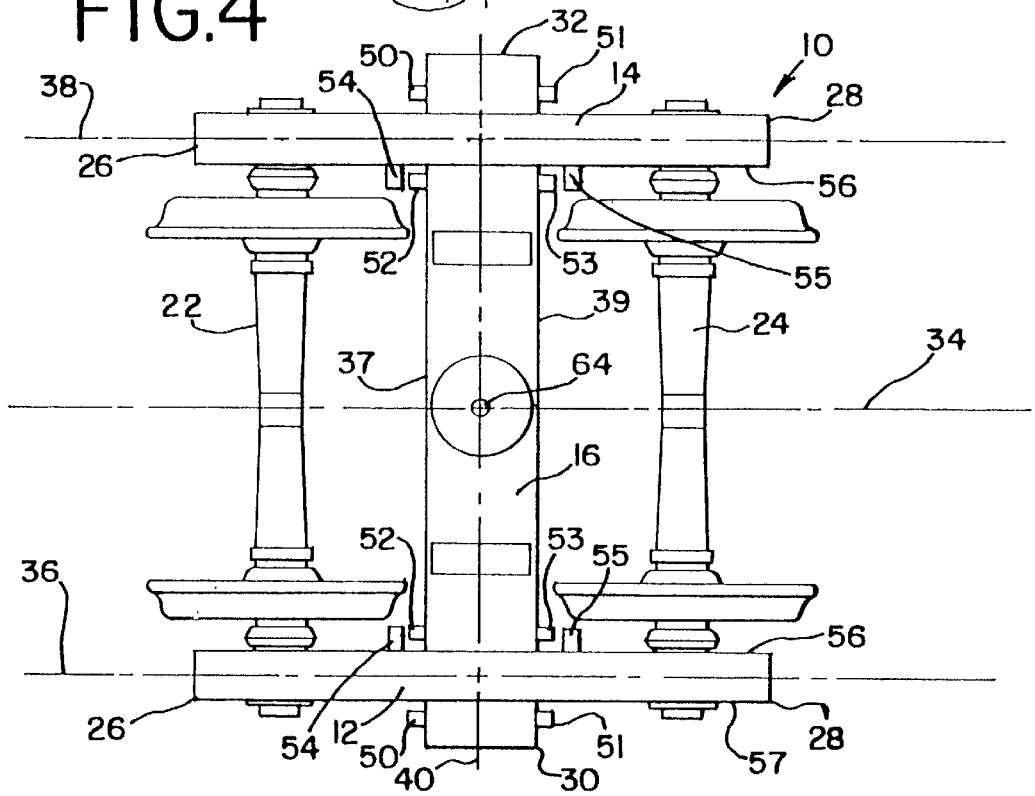
FIG. 4 is a diagrammatic top plan view of a three-piece railcar truck assembly at a reference, normal or as-assembled position.

Railcar truck assembly 10 in FIG. 1 is a representative three-piece truck assembly for a freight railcar (not shown). Assembly 10 has a first side frame 12, a second side frame 14 and bolster 16 extending between generally central openings 18, 20, which openings 18, 20 are between forward side frame column 17 and rearward side frame column 19, of the first and second side frames 12, 14, respectively. In FIGS. 1 and 4, railcar truck assembly longitudinal axis 34 is generally parallel to side frame longitudinal axes 36, 38. Bolster longitudinal axis 40 is generally perpendicular to railcar truck longitudinal axis 34 and to side frame longitudinal axes 36, 38 at the as-assembled position shown in FIGS. 1 and 4, corresponding with a warp reference position. First axle and wheel set 22 and second axle and wheel set 24 extend between side frames 12, 14 at their opposite forward ends 26 and rearward ends 28, respectively. The side frames 12, 14 are generally parallel to each other at the reference, as-assembled condition shown in FIGS. 1 and 4. First bolster end 30 is nested in first side frame opening 18 and second bolster end 32 is nested in second side frame opening 20.

Figure 2:
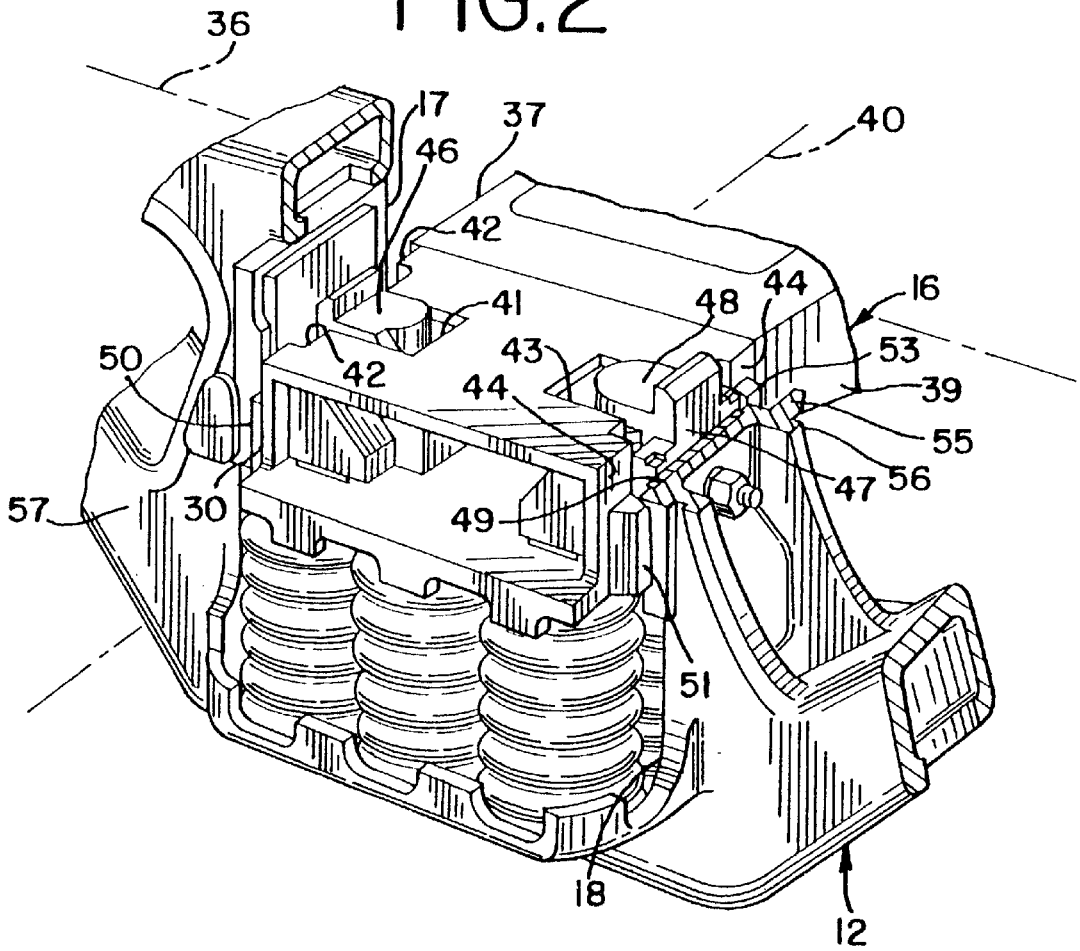
FIG. 2 is an enlarged oblique view in partial section of a portion of one side frame and bolster connection in FIG. 1 at the columns of one side frame.

The connection of bolster 16 in openings 18 and 20 is similarly configured for either side frame 12, 14, and the following description will be provided for the connection of bolster first end 30 at the first side frame opening 18, but the description will also be applicable to the connection of the bolster second end 32 in second side frame opening 20. The first bolster end 30 has exposed bolster columns 42, 44 between outboard gibs 50, 51 and spaced inboard gibs 52, 53 on both the forward side 37 and rearward side 39 of the bolster (see FIGS. 2 and 4–5). Each bolster column 42, 44 may have friction shoe pockets, shown at 41 and 43 in FIG. 2. There may be friction shoes 46, 48 in each friction shoe pocket. The bolster may have a constant control type of friction shoe or a variable control type of friction shoe, having a vertical wearing surface 47, or the bolster columns 42, 44 may comprise a continuum between the gibs 50, 52 and between gibs 51, 53, as disclosed in U.S. patent application Ser. No. 08/850,178 entitled "Improved Bolster Land Arrangement for Railcar Truck", filed on May 2, 1997 by V. Terrey Hawthorne, Charles Moehling, Charles P. Spencer and Terry L. Pitchford, which is incorporated by reference herein in its entirety. At each end of the bolster 16, friction shoe pockets 41, 43 and friction shoes 46, 48 as well as bolster columns 42, 44 are longitudinally arranged on forward side wall 37 and rearward side wall 39 of bolster 16, respectively. A wear plate 49 may be attached to each side frame column 17, 19 to bear against the wearing surfaces 47.

Figure 5:
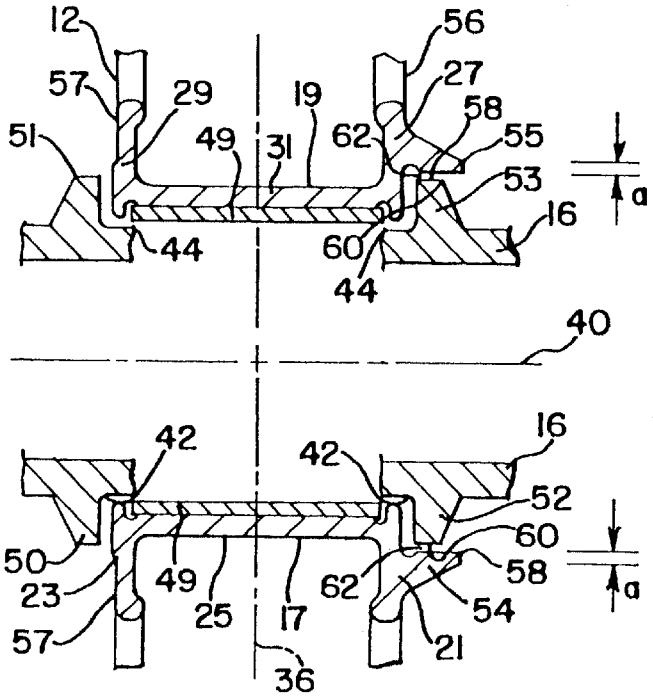
FIG. 5 is a cross-section of a side frame-bolster interface of a railcar truck assembly, with parts removed for clarity, the side frames and bolster being of the types shown in FIGS. 1–4.

As shown in FIGS. 2–5, the illustrated prior art side frame 12 has an inboard side 56, and an outboard side 57. As shown in FIG. 5, each side frame forward column 17 includes an inboard web 21, an outboard web 23, and a transverse web 25 between the inboard and outboard column webs. Each side frame rearward column 19 includes an inboard web 27, an outboard web 29 and a transverse web 31 between the inboard and outboard column webs. Each side frame opening 18, 20 is between the opposed transverse webs 25, 31 of the columns 17, 19 of the two side frames 12, 14.

As shown in FIGS. 2–5, there is a forward rotation stop lug 54 on the inboard side 56 of the forward column 17 of the side frame and a rearward rotation stop lug 55 on the inboard side 56 of the rearward column 19. The forward rotation stop lug 54 extends toward the truck assembly central longitudinal axis 34 from the forward inboard column web 21 and is aligned opposite the forward inboard bolster gib 52. The rearward rotation stop lug 55 extends toward the truck assembly central longitudinal axis 34 from the rearward inboard column web 27 and is aligned opposite the rearward inboard bolster gib 53. Each rotation stop lug 54, 55 has a stop surface 58 spaced from and parallel to a stop surface 60 on the inboard bolster gibs 52, 53. There is a gap 62 between the opposed stop surfaces 58, 60 of each of the opposed rotation stop lugs and the gibs. The gap distance is shown at "a" in FIG. 5, and may be, for example, about 3/32 inch, as disclosed in U.S. Pat. No. 3,109,387 (1963) to Carl E. Tack and entitled "Side Frame-Bolster Interlocking Arrangement for Snubbed Trucks". The gap distance has generally been set in these prior art designs to control rotation of the bolster 16 about its longitudinal axis 40. While some freedom of relative rotation between the bolster 16 and the side frame 12 and relative to a horizontal plane has been required to allow the truck assembly to traverse tracks of varying elevations, the opposed stop surfaces 58, 60 of the rotation stop lugs 54, 55 and inboard bolster gibs 52, 53 have restricted this relative rotation to a pre-determined range of motion, as described in U.S. Pat. No. 3,109,387.

Figure 3:
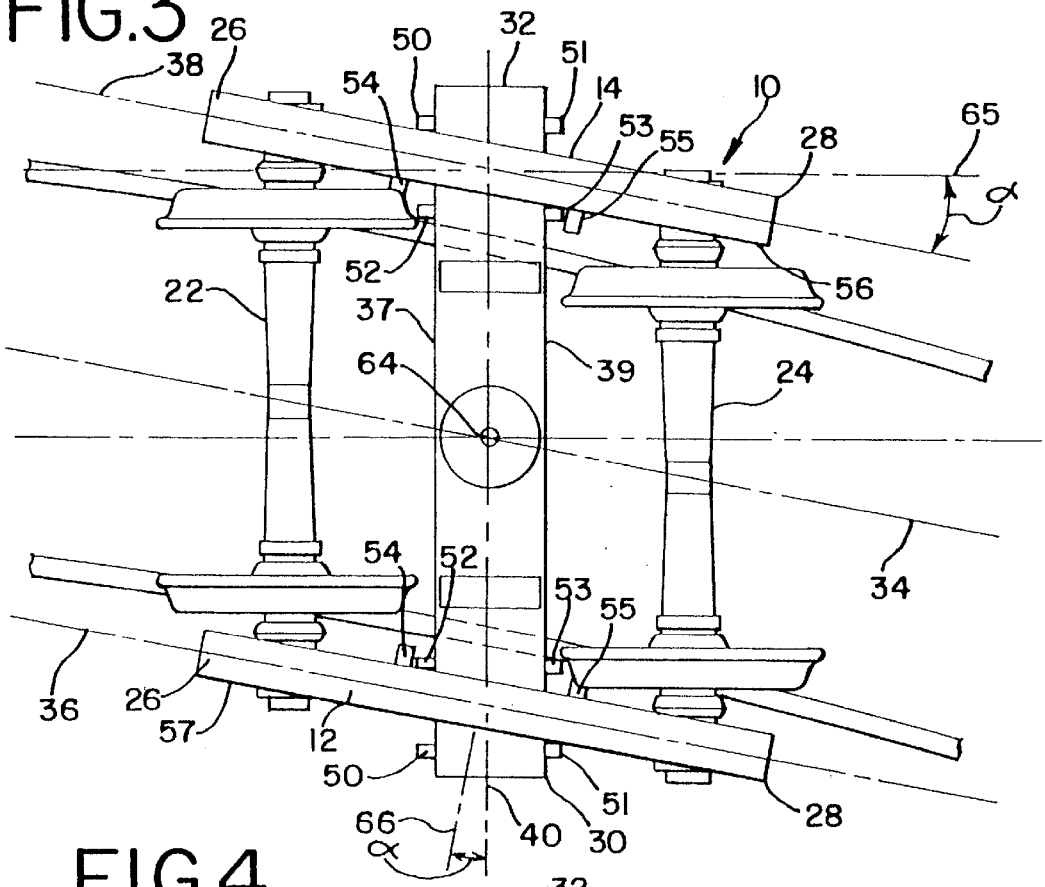
FIG. 3 is a diagrammatic top plan view of a three-piece railcar truck assembly being warped during negotiation of a curve on a railroad track.

Truck warping involves rotation of the bolster 16 about a vertical axis, such as central vertical axis 64 in FIGS. 3–4, so that the longitudinal axes 36, 38 of the side frames 12, 14 and longitudinal axis 40 of the bolster 16, respectively, are no longer perpendicular. An example of such undesirable warping is illustrated in FIG. 3, wherein the angle "a" is the truck warp angle, that is, the angle defined by the side frame longitudinal axis 38 with a reference line 65 that is perpendicular to the bolster longitudinal axis 40; the truck warp angle "a" is also the angle defined by the bolster central longitudinal axis 40 with a reference line 66 that is perpendicular to the side frame longitudinal axes 36, 38. Thus, the truck warp angle corresponds with the angular displacement of the bolster longitudinal axis 40 and the side frame longitudinal axes 36, 38 from the warp reference position shown in FIG. 4. As disclosed in U.S. patent application Ser. No. 08/850,178 entitled "Improved Bolster Land Arrangement for Railcar Truck", filed on May 2, 1997, truck warping is problematic: it can lead to premature wearing of the wheels, and can lead to increased hunting and poor curving performance of the truck assemblies.

In the present invention, the problem of truck warping is addressed. Outboard lugs or stops 100, 102 are provided on each side frame 12, 14, opposite and aligned with the bolster outboard gibs 50, 51, and the gaps 62, 104 are restricted between all of the aligned inboard and outboard side frame lugs 54, 55, 100, 102 and the inboard and outboard bolster gibs 50, 51, 52, 53. With the gaps 62, 104 restricted on both the inboard 56 and outboard 57 sides, the permissible range of relative rotation of the bolster 16 about a vertical axis such as central vertical axis 64 is restricted. With the range of rotation about vertical axis 64 restricted, the truck warp angle a may be controlled and minimized.

Figure 6:
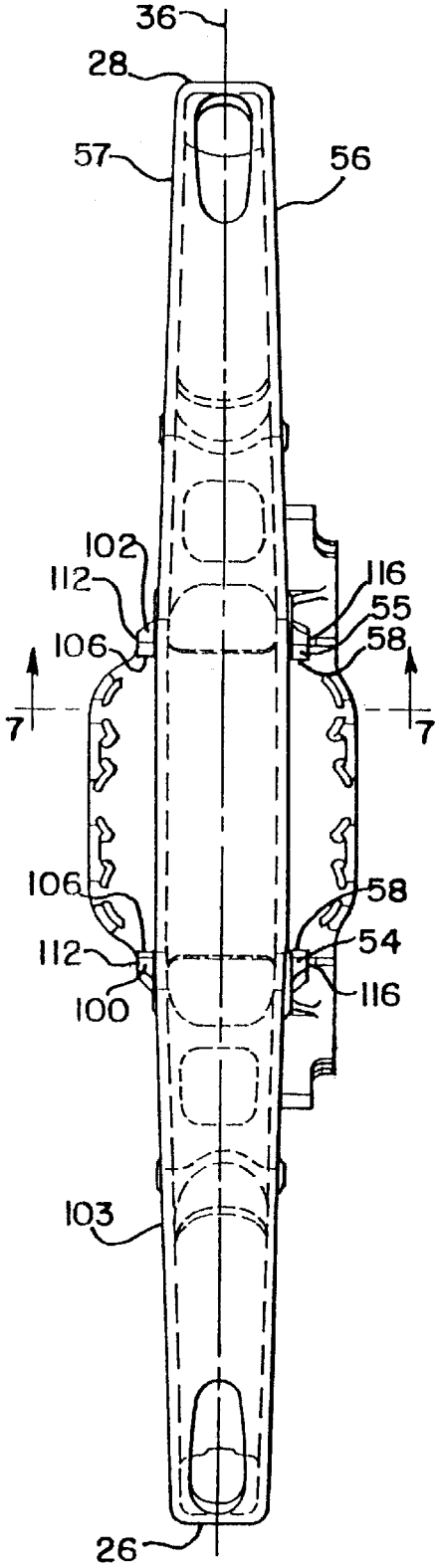
FIG. 6 is a top plan view of a first embodiment of a side frame incorporating the teachings of the present invention.
Figure 7:
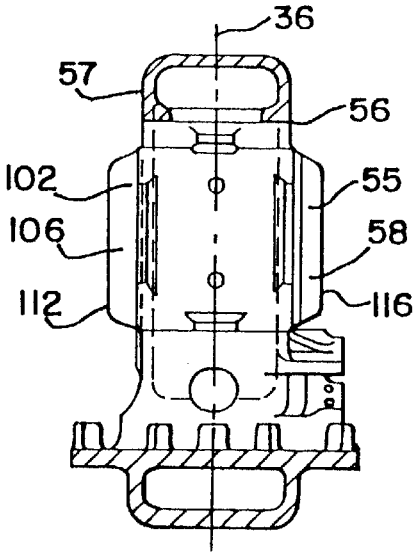
FIG. 7 is a cross-section taken along line 7—7 of FIG. 6.
Figure 8:
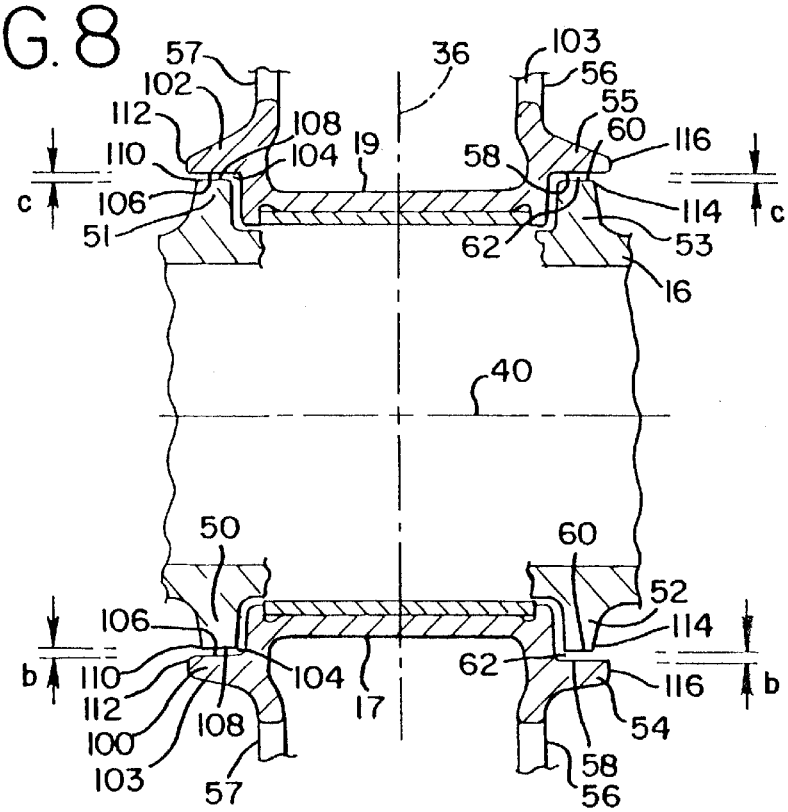
FIG. 8 is a cross-section of a side frame-bolster interface for a railcar truck assembly, with parts removed for clarity, the side frame of the type shown in FIGS. 6, 7 and 9.
Figure 9:
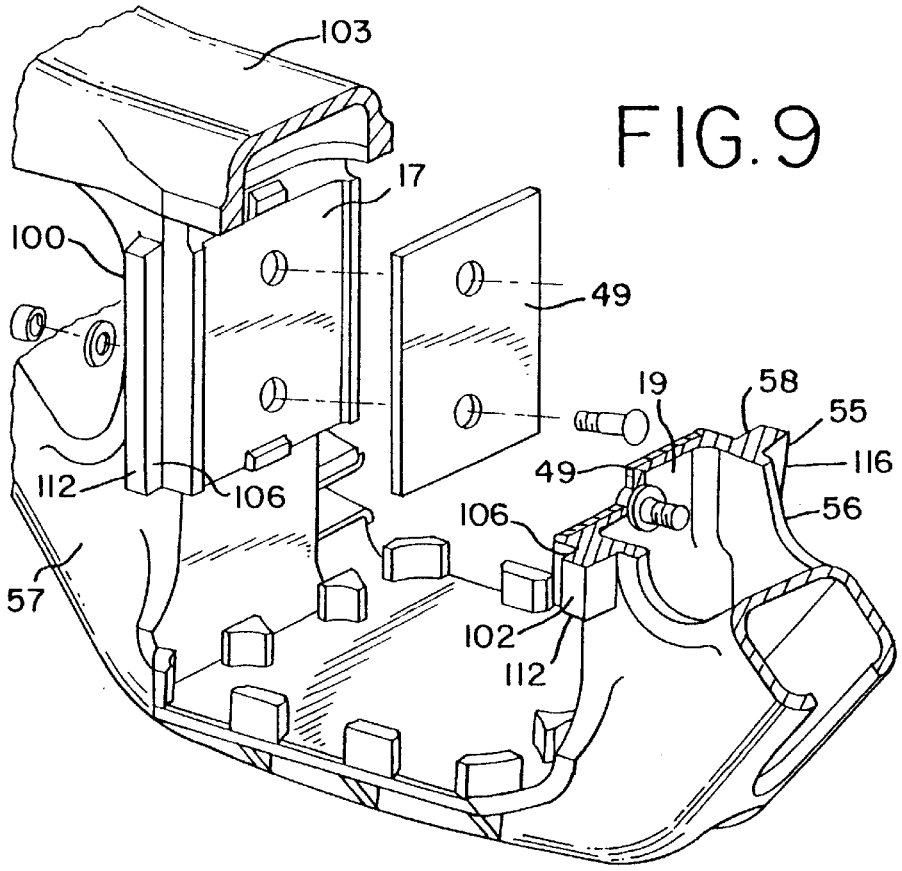
FIG. 9 is a partial oblique view of the side frame of FIG. 6, with part shown in section.

A first embodiment of a side frame 103 embodying the principles of the present invention is illustrated in FIGS. 6–8, and such a side frame 103 with a bolster 16 is shown in cross-section in FIG. 9. As there shown, like reference numerals have been used for like parts of the side frames and bolster shown in FIGS. 14. In the first illustrated embodiment, forward and rearward outboard lugs 100, 102 are included on the side frame 103, with a gap 104 between stop surfaces 106 of the side frame outboard lugs 100, 102 and stop surfaces 108 of the outboard bolster gibs 50, 51. This gap 104 and the gap 62 between the stop surfaces 58 of the inboard side frame lugs 54, 55 and the opposing stop surfaces 60 of the inboard bolster gibs 50, 51 may be substantially restricted to control and limit the truck warp angle a.

In the first embodiment of the present invention, the forward outboard lug 100 extends outwardly from the outboard web 23 of the forward side frame column 17. The rearward outboard lug 102 extends outwardly from the outboard web 29 of the rearward side frame column 19.

Figure 10:
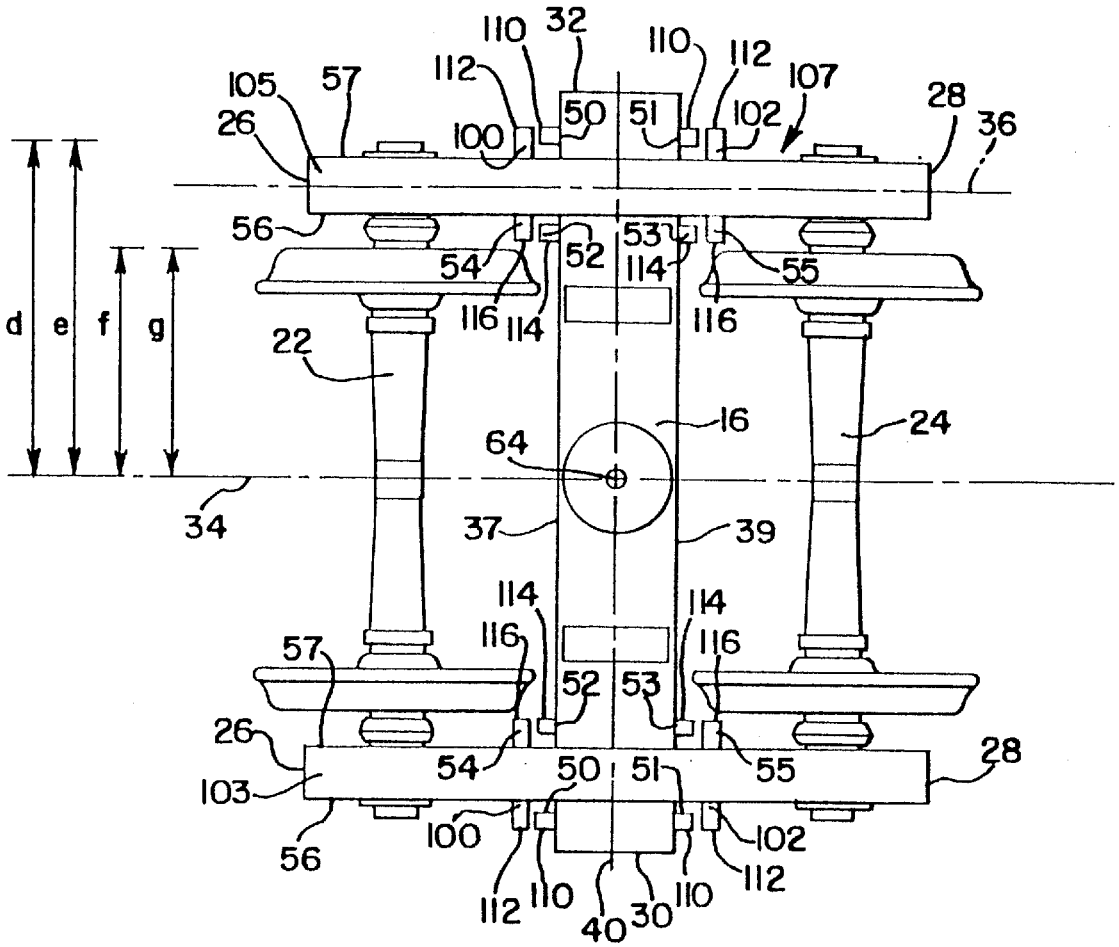
FIG. 10 is a diagrammatic top plan view of a three-piece railcar truck assembly of the present invention at a reference, normal or as-assembled position, with the bolster and side frames at a warp reference position.

At least a part of the stop surface 106 of the forward outboard side frame lug 100 faces rearward and is generally perpendicular to the side frame longitudinal axis 36. At least a part of the stop surface 108 of the forward outboard bolster gib 50 is in a facing relationship with at least a part of the stop surfaces 106 of the forward outboard side frame lug 100, and at least parts of the stop surfaces 106, 108 are in proximity to each other. Together, the outboard forward side frame lug 100 and outboard forward bolster gib 50 at one end 30 of the bolster define an outboard forward neighboring side frame lug and gib, shown in FIGS. 8 and 10. At least a part of the stop surface 106 of the rearward outboard side frame lug 102 faces forward and is generally perpendicular to the side frame longitudinal axis 36. At least a part of the stop surface 106 of the rearward outboard side frame lug 102 is in a facing relationship with the rearward facing stop surface 108 of the rearward outboard bolster gib 51, and the stop surfaces 106, 108 are in proximity to each other. Together, the outboard rearward side frame lug 102 and outboard rearward bolster gib 51 at one end 30 of the bolster define an outboard rearward neighboring side frame lug and gib, shown in FIGS. 8 and 10. On the inboard side, at least a part of the stop surface 58 of the inboard forward side frame lug 54 faces rearward and is generally perpendicular to the side frame longitudinal axis 36. At least a part of the stop surface 58 of the inboard forward side frame lug 54 is in a facing relationship with at least a part of the stop surface 60 of the inboard forward bolster gib 52. Together, the inboard forward side frame lug 54 and inboard forward bolster gib 52 at one end 30 of the bolster define an inboard forward neighboring side frame lug and gib, as shown in FIGS. 8 and 10. At least a part of the stop surface 58 of the inboard rearward side frame lug 55 faces forward and is generally perpendicular to the side frame longitudinal axis 36. At least a part of the stop surface 58 of the inboard rearward side frame lug 55 is in a facing relationship with at least a part of the stop surface 60 of the inboard rearward bolster gib 53. Together, the inboard rearward side frame lug 55 and inboard rearward bolster gib 53 at one end of the bolster 30 define an inboard rearward neighboring side frame lug and gib, as shown in FIGS. 8 and 10. As shown in FIG. 10, both side frames are similarly configured, and it should be understood that the above description applies as well to the interface of the other end 32 of the bolster in the second side frame 105. In the first illustrated embodiment, the stop surfaces 108 of the outboard bolster gibs 50, 51 are parallel to the bolster longitudinal axis 40 and to the opposing stop surfaces 106 of the side frame outboard lugs 100, 102 when the three-piece truck assembly is in the as-assembled condition as shown in FIG. 10.

The magnitude of the gaps 62, 104 between each pair of opposed stop surfaces 106, 108 on the outboard side 57 are shown at "b" and "c" in FIG. 8. The gap distances "b" and "c" may each be in the range of about 0.2 to 1/64 (0.015) inches, and each gap is preferably less than 3/32 inch and in the range of 3/64–1/64 inches. In the first illustrated embodiment, the gap distances "b" and "c" are equal in the as-assembled condition of the railcar truck assembly, shown in FIG. 10, and the same gap distances "b" and "c" are used on both the inboard and outboard sides of the truck assembly. The total of the gap distance "b" between at least a part of the stop surfaces 58, 60 of the inboard forward neighboring side frame lug and bolster gib 54, 52 and the gap distance "c" between at least a part of the stop surfaces 58, 60 of the inboard rearward neighboring side frame lug and bolster gib 55, 53 in the illustrated embodiment is the overall clearance or total separation, and is less than 0.4 inch, and is preferably less than 3/16 inch and in the range between 3/32 and 1/32 inches. The total of the gap distance "b" between at least a part of the stop surfaces 106, 108 of the outboard forward neighboring side frame lug and bolster gib 100, 50 and the gap distance "c" between at least a part of the stop surfaces 106, 108 of the outboard rearward neighboring side frame lug and bolster gib 102, 51 in the illustrated embodiment is the overall clearance or total separation, and is less than 0.4 inches, and is preferably less than 3/16 inch and in the range between 3/32 and 1/32 inches. Both gap distance totals, b plus c, that is, both overall clearances or total separation distances, on both the inboard 56 and outboard 57 sides of the side frame 103 are the same in the first illustrated embodiment. It should be understood that the other side frame 105 of the three-piece truck 107 may be of the same construction as the side frame 103 described above, and that the two side frames 103, 105 may be assembled with a bolster 16 to form a three-piece truck of the type shown in FIG. 1, except for the additional lugs 100, 102 on both side frames and reduced gaps 62, 104. The total gap distances b plus c, that is the overall clearance or total separation distance, on the other side frame and other end 32 of the bolster 16 may also be the same on both the inboard and outboard sides. It should be understood that like reference numbers have been used for like parts in the truck assembly of FIG. 10 and the prior art truck of FIGS. 14, for like parts of the side frames 103, 105 and the prior art side frames 12, 14, and for like parts of the bolsters 16.

With the additional outboard side frame lugs 100, 102 of the present invention, and with the tight spacing between all of the side frame lugs 54, 55 100, 102 and opposing bolster gibs 50, 51, 52, 53, warp angles should be substantially reduced. It may be possible, for example, to achieve maximum truck warp angles of less than 2° and preferably in the range of about 0.2° to 2°, thereby reducing the potential for damage from warping and truck hunting.

It should be understood that many variations of the design illustrated in FIGS. 6–9 may be employed, and that the present invention encompasses these variations. Generally, at least a part of the stop surfaces 58, 60, 106, 108 of each neighboring bolster gib and side frame lug, 50 and 100, 51 and 102, 52 and 54, and 53 and 55, are sized, shaped and spaced so that at least one of the outboard neighboring bolster gibs and side frame lugs, such as either the combination of gib 50 and lug 100 or the combination of gib 51 and lug 102, and the diagonally opposite inboard neighboring bolster gib and side frame lug, such as either the combination of gib 53 and lug 55 or the combination of gib 52 and lug 54, respectively, limit rotation of the bolster about a vertical axis 64. Thus, the truck warp angle a may be controlled, preferably being limited to an angle of about 2° or less and preferably in the range of about 0.2° to 2°.

As shown in FIGS. 9–10, the outboard forward and rearward bolster gibs 50, 51 have outboard limits 110 and the neighboring outboard forward and rearward side frame lugs 100, 102 have outboard limits 112. The inboard forward and rearward bolster gibs 52, 53 have inboard limits 114 and the neighboring inboard forward and rearward side frame lugs 54, 55 have inboard limits 116. As shown in FIG. 10, in this embodiment, at the warp reference position, the distance "d" between the central axis 34 of the truck assembly and the outboard limits 112 of the side frame lugs 100, 102 is at least as great as the distance "e" between the central axis of the truck assembly and the outboard limits 110 of the outboard bolster gibs 50, 51. The distance "f" between the central axis 34 of the truck assembly and the inboard limits 116 of the inboard side frame lugs 54, 55 is no greater than the distance "g" between the central axis 34 and the inboard limits 114 of the inboard bolster gibs 52, 53. The neighboring side frame lugs and bolster gibs at the other end 32 of the bolster are similarly configured.

Alternate shapes may be used for the bolster gibs and side frame lugs of the present invention, such as those disclosed for the land surfaces in U.S. patent application Ser. No. 08/850,178 entitled "Improved Bolster Land Arrangement for Railcar Truck", filed on May 2, 1997 by V. Terrey Hawthorne, Charles Moehling, Charles P. Spencer and Terry L. Pitchford.

Since it is also desirable that the railcar truck be able to traverse track of differing elevations, it will also be desirable to allow a greater range of possible relative rotation between the side frames and the bolster about a horizontal axis 40 than is allowed about the vertical axis 64, as disclosed in the application for U.S. patent entitled "Side Frame-Bolster Interface for Railcar Truck Assembly", filed concurrently herewith by V. Terrey Hawthorne and bearing docket no. 6178, the disclosure of which is incorporated by reference herein in its entirety. Any of the embodiments disclosed in that patent application can be applied as well to the inboard and outboard side frame lugs or bolster gibs to allow a greater range of rotation about the central longitudinal axis 40 of the bolster than about the central vertical axis 64 of the bolster. In effect, the side frame lugs or bolster gibs or both may be shaped so that part of the contact surfaces control the warp angle and part controls pitch angle. Thus, one or both of the contact surfaces of each neighboring side frame lug and bolster gib may comprise a warp control surface and a pitch control surface. The gap distances "b" and "c" between the warp control surfaces may each be less than 3/32 inch and in the preferred range of 3/64–1/64 inches while the gap distance between the pitch control surfaces may be at greater distances. Thus, at a gap of 1/64 inch between the warp control surfaces, the opposing warp control surfaces of the side frame lugs and bolster gibs may limit the truck warp angle to 0.22°, or about 0.2°, and gaps in the range of 1/64–3/64 inches may limit the truck warp angles to the range of about 0.2°–2°, while the opposing pitch control surfaces of the side frame lugs and bolster gibs allow a greater range of pitch angles. Examples of such shapes are illustrated in FIGS. 11–14, but it should be understood that any shape disclosed in that patent application may be used at any of the side frame lugs and bolster gibs. It should also be understood that any of the shapes disclosed in that application may be combined with any of the shapes disclosed in U.S. patent application Ser. No. 08/850,178.

Figure 11:
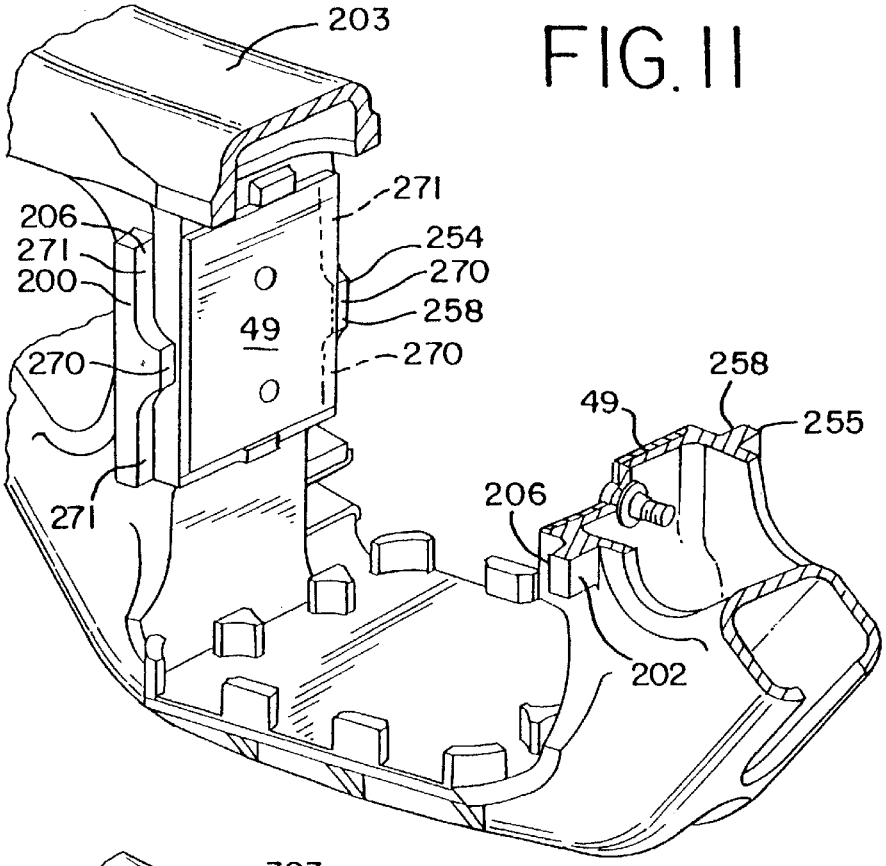
FIG. 11 is an oblique view in partial section of another embodiment of a side frame incorporating the features of the present invention.
Figure 12:
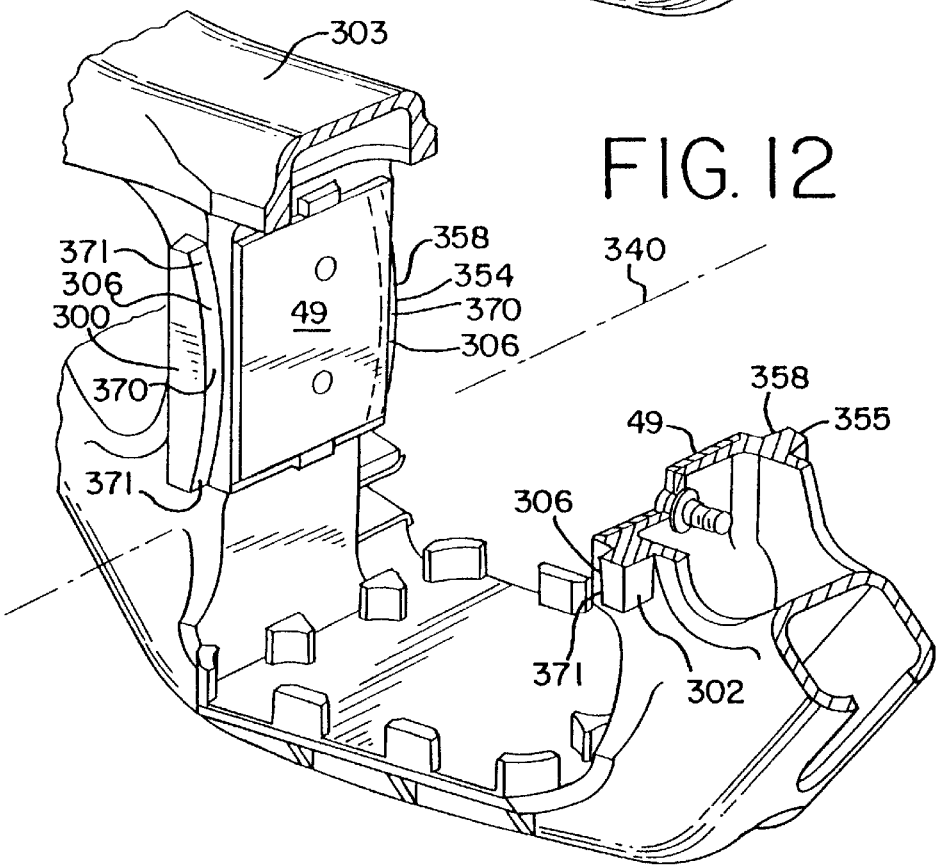
FIG. 12 is an oblique view in partial section of another embodiment of a side frame incorporating the features of the present invention.
Figure 13:
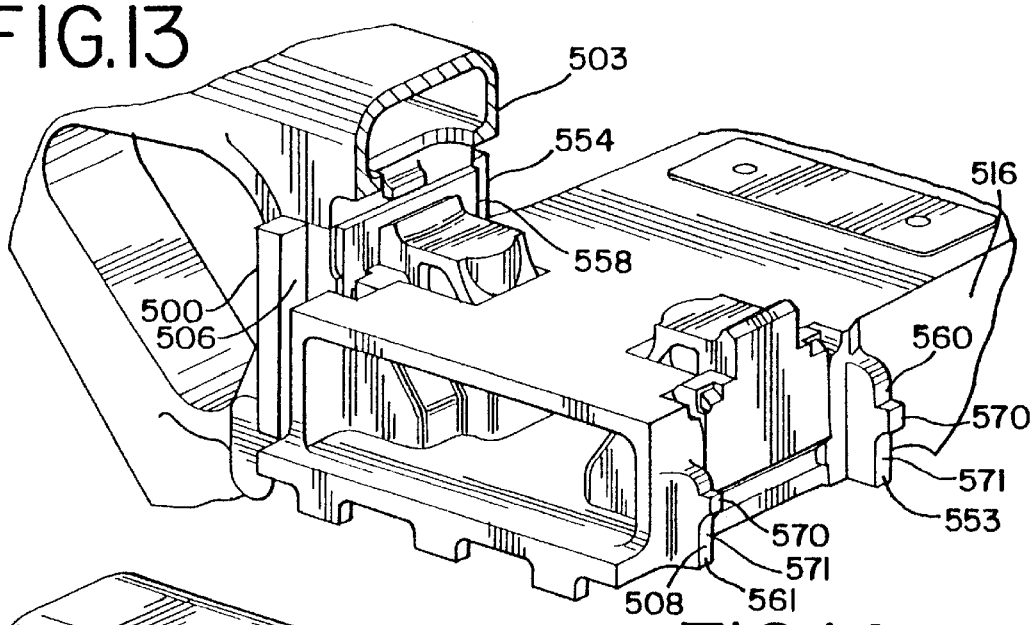
FIG. 13 is an oblique view, in partial section and with parts removed for clarity, of another embodiment of a side frame-bolster interface.
Figure 14:
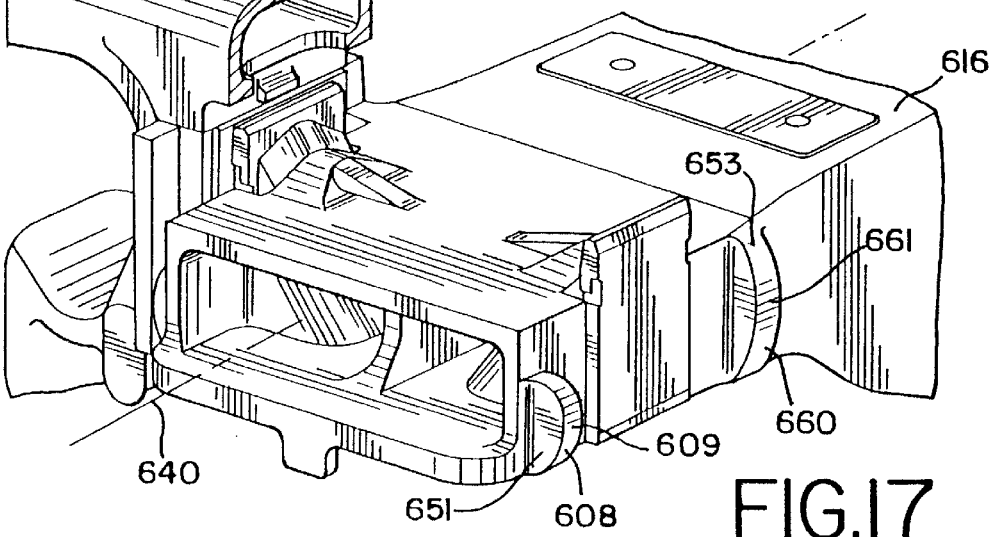
FIG. 14 is an oblique view, in partial section and with parts removed for clarity, of another embodiment of a side frame-bolster interface.

As shown in FIG. 11 of the present application, the side frames 203 may have inboard lugs 254, 255 and outboard lugs 200, 202 with stop surfaces 258, 206 that each include a warp control surface 270 and a relief surface 271 for pitch control. The gibs of the bolster (not shown) may have stop surfaces that are flat and vertical, so that the entire gib stop surface comprises a warp control surface and a pitch control surface, or the stop surfaces could also include warp and pitch control surfaces such as shown in FIGS. 13–14. As shown in the embodiment of FIG. 12, the side frame 303 inboard lugs 354, 355 and outboard lugs 300, 302 may have stop surfaces 358, 306 that comprise curved surfaces, with outermost points 370 comprising warp control surfaces and the remainder of the stop surfaces comprising relief surfaces 371 that curve away from the side frame central transverse axis 340 to allow the bolster (not shown) to pitch within a predetermined range of angles.

As shown in FIG. 13 of the present application, the bolster 516 may have inboard gibs 553 and outboard gibs 561 with stop surfaces 560, 508 that each include a warp control surface 570 and a relief surface 571 for pitch control. The lugs 500, 554 of the side frame 503 may have stop surfaces 558, 506 that are flat and vertical, as in the embodiment of FIGS. 6–9, so that the entire stop surface 558, 506 comprises both a warp control surface and a pitch control surface, or the stop surfaces could also include both warp control surfaces and relief surfaces such as shown in FIG. 12. In any of the embodiments of FIGS. 11–14, each pair of opposing warp control surfaces may be spaced at a distance less than 3/32 inch and preferably in the range of 3/64–1/64 inches, with the relief surfaces spaced at a greater distance to allow the bolster 516 or 616 to have a range of pitch angles greater than the warp angle. Limiting the total separation or overall clearance to a distance less than 0.4 inch and preferably less than 3/32 inch and closer to 1/32 inch limits the truck warp angle to an angle between about 0.2° and 2.0° while the larger gap between the side frame contact surface and the relief or pitch control surface of the bolster gibs may allow a greater maximum pitch angle of, for example, 1.0°, 2.0°, or some other angle, depending on the depth of the relief provided. As shown in the embodiment of FIG. 14, the inboard gibs 653 and outboard gibs 651 of the bolster 616 may have stop surfaces 608, 660 that comprise curved surfaces, with the outermost points 609, 661 comprising warp control surfaces and the remainder of the stop surfaces comprising relief surfaces that curve toward the bolster longitudinal centerline 640 to allow the bolster 616 to pitch within a predetermined range of angles.

Figure 17:
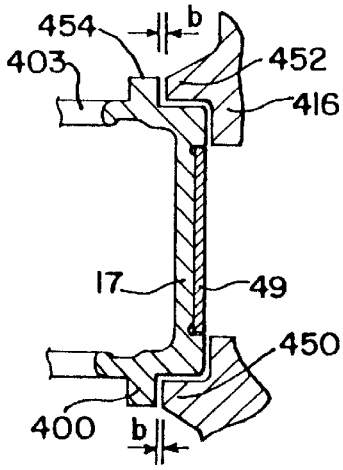
FIG. 17 is a cross-section of a wide land type of side frame and bolster for a railcar truck assembly, showing one side frame-bolster interface, with parts removed for clarity, incorporating the features of the present invention.

In addition, as shown in the embodiment of FIG. 17, the present invention may also be used with side frames 403 and bolsters 416 of the wide land type. In prior art wide land side frames, there have been no side frame lugs. In the present invention, both inboard side frame lugs such as lug 454 and outboard side frame lugs such as lug 400 may be used along with bolsters 416 having inboard gibs and outboard gibs such as inboard gib 452 and outboard gib 450 of the FIG. 17 embodiment. In this embodiment, the gap distance "b" and the gap distance "c" (not shown) would again be used to control or limit the warp angle. It should be understood that any of the above-described shapes of lugs and gibs may be used with the wide land type of side frame.

Figure 15:
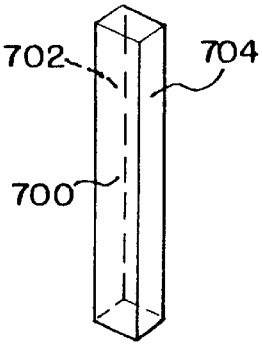
FIG. 15 is an oblique view of a separate stop member that may be mounted on a side frame or bolster in accordance with the teachings of the present invention.
Figure 16:
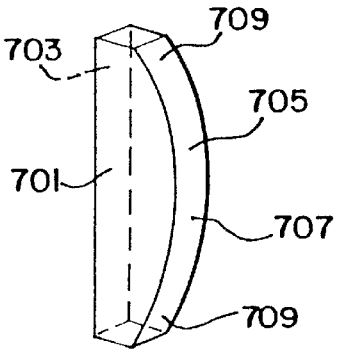
FIG. 16 is an oblique view of an alternate stop member that may be mounted on a side frame or bolster in accordance with the teachings of the present invention.

The side frame and bolster of the present invention may be made as a steel casting with the additional outboard lugs and gibs cast as parts of the side frame and bolster. To achieve the gaps distances "b" and "c", it should be understood that the dimensions of the side frame lugs or bolster gibs or both may be set to provide the desired gaps, with the lugs and gibs being cast with or machined to the desired dimensions. Alternatively, side frames and bolsters could be cast with the lugs and gibs at greater than the desired gap distance and then modified to provide the desired gap distances, or standard side frames and bolsters could be modified to provide the desired gap distances, by providing separate plates or other structures to be attached to either the side frames or bolsters or both of them. The gap reductions could be achieved through the addition of wear plates or the like to the lugs or gibs so that manufacturing tolerances for the side frames and bolsters can be greater. For these purposes, the wear plates could be made of a hardened material, for example, or could comprise a resilient material that compresses a pre-determined amount. The wear plates or resilient material could be shaped, for example, like the wear members 700, 701 illustrated in FIGS. 15 and 16, with attachment surfaces 702, 703 for attachment to the side frame or bolster adjacent or opposite to the stop surfaces 704, 705. As shown in FIG. 16, the wear member 701 may be shaped to provide a warp control surface 707 and relief surfaces 709. If a resilient material is used, the resilient material could be placed between the opposing contact surfaces of the side frame lugs and the bolster gibs, in contact with both opposing stop surfaces of each pair; in such an embodiment, the gap distance "b" or "c" could comprise the thickness of the resilient material in the as-assembled truck assembly such as that shown in FIG. 10. The means of attaching such a wear plate or resilient material to the side frame or bolster should be understood to vary with the material used; a steel wear plate could be welded to the desired part of the side frame or bolster, and either type of material could be attached by nuts and bolts, screws, adhesive, or any other desirable means. Use of structures such as those shown in FIGS. 15 and 16 may be advantageous in that it may be relatively easy to replace the structures if they become worn through use. It should be understood that other materials could be used as well, and the present invention is not limited to any particular material or method of manufacture.

While specific gap distances and truck warp angles have been set forth herein, it should be understood that the distances and angles have been given for purposes of illustration only. The present invention is not limited to any particular gap distance or warp angle unless expressly set forth in one of the claims. It should also be understood that from the disclosure in this application, once a desired range of warp angles has been determined, the necessary gap may be determined from the dimensions and geometry of the particular side frames and bolster used in the railcar truck assembly.

While only specific embodiments of the invention have been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures as well as structural equivalents to those described herein.

I claim:

1. A three-piece railcar truck assembly comprising a bolster and a pair of side frames, said three-piece railcar truck assembly having a longitudinal axis and a perpendicular transverse axis;

each side frame having a longitudinal axis, a forward column and a rearward column, each forward column including an inboard forward column web, an outboard forward column web and a transverse forward column web between the inboard forward column web and outboard forward column web, each rearward column including an inboard rearward column web, an outboard rearward column web, and a transverse rearward column web between the inboard rearward column web and outboard rearward column web, each side frame forward column and rearward column cooperating to define an opening in said side frame between the transverse forward column web and transverse rearward column web, each side frame further including an inboard forward lug on the inboard forward column web, an inboard rearward lug on the inboard rearward column web, an outboard forward lug on the outboard forward column web, and an outboard rearward column lug on the outboard rearward column web, each side frame lug having a stop surface;

said bolster having a first end, a second end, a forward side and a rearward side, a forward inboard bolster gib and a forward outboard bolster gib at said bolster forward side at each said bolster first and second ends and a rearward inboard bolster gib and a rearward outboard bolster gib at said bolster rearward side at each said bolster first and second ends, each of said bolster ends matable with the opening in each side frame defined by the forward and rearward side frame columns, said forward inboard and outboard bolster gibs at each bolster end cooperating to define a clearance between said forward inboard and outboard bolster gibs greater than the width of the forward transverse column web of the side frame receiving the bolster end, said rearward inboard and outboard bolster gibs at each bolster end cooperating to define a clearance between said rearward inboard and outboard bolster gibs greater than the width of the rearward transverse column web of the side frame receiving the bolster end, said forward and rearward inboard and outboard bolster gibs each having a stop surface;

one inboard forward side frame lug and one inboard forward bolster gib at one end of the bolster defining an inboard forward neighboring side frame lug and bolster gib;

one inboard rearward side frame lug and one inboard rearward bolster gib at one end of the bolster defining an inboard rearward neighboring side frame lug and bolster gib;

one outboard forward side frame lug and one outboard forward bolster gib at one end of the bolster defining an outboard forward neighboring side frame lug and bolster gib;

one outboard rearward side frame lug and one outboard rearward bolster gib at one end of the bolster defining an outboard rearward neighboring side frame lug and bolster gib;

at least part of the stop surfaces of each neighboring side frame lug and bolster gib being in facing relationship and in proximity to each other;

the total of the distance between at least a part of the stop surfaces of the inboard forward neighboring side frame lug and bolster gib at one end of the bolster and the distance between at least a part of the stop surfaces of the inboard rearward neighboring side frame lug and bolster gib at the same end of the bolster being less than 3/16 inch; and the total of the distance between at least a part of the stop surfaces of the outboard forward neighboring side frame lug and bolster gib at one end of the bolster and the distance between at least a part of the stop surfaces of the outboard rearward neighboring side frame lug and bolster gib at one end of the bolster being less than 3/16 inch.

2. The three-piece railcar truck assembly of claim 1 wherein the total of the distance between at least a part of the stop surfaces of the inboard forward neighboring side frame lug and bolster gib at one end of the bolster and the distance between at least a part of the stop surfaces of the inboard rearward neighboring side frame lug and bolster gib at the same end of the bolster is between 3/16 inch and 1/32 inch; and the total of the distance between at least a part of the stop surfaces of the outboard forward neighboring side frame lug and bolster gib at one end of the bolster and the distance between at least a part of the stop surfaces of the outboard rearward neighboring side frame lug and bolster gib at the same end of the bolster being between 3/16 inch and 1/32 inch.

3. The three-piece railcar truck assembly of claim 1 wherein each bolster gib has a longitudinal limit surface substantially perpendicular to the bolster gib stop surface and spaced from and in facing alignment with one of the side frame column inboard and outboard column webs.

4. The three-piece railcar truck assembly of claim 1 wherein the distance between at least part of the stop surfaces of the inboard forward neighboring side frame lug and bolster gib is in the range of 3/64–1/64 inches.

5. The three-piece railcar truck assembly of claim 1 wherein the distance between at least part of the stop surfaces of the inboard rearward neighboring side frame lug and bolster gib is in the range of 3/64–1/64 inches.

6. The three-piece railcar truck assembly of claim 1 wherein the distance between at least part of the stop surfaces of the outboard forward neighboring side frame lug and bolster gib is in the range of 3/64–1/64 inches.

7. The three-piece railcar truck assembly of claim 1 wherein the distance between at least part of the stop surfaces of the outboard rearward neighboring side frame lug and bolster gib is in the range of 3/64–1/64 inches.

8. The three-piece railcar truck assembly of claim 7 wherein the distance between at least part of the stop surfaces of the inboard forward neighboring side frame lug and bolster gib is in the range of 3/64–1/64 inches, the distance between at least part of the stop surfaces of the inboard rearward neighboring side frame lug and bolster gib is in the range of 3/64–1/64 inches, and the distance between at least part of the stop surfaces of the outboard forward neighboring side frame lug and bolster gib is in the range of 3/64–1/64 inches.

9. A three-piece railcar truck assembly comprising a bolster and a pair of side frames, said three-piece railcar truck assembly having a longitudinal axis and a perpendicular transverse axis;

each side frame having a longitudinal axis, a forward column and a rearward column, each forward column including an inboard forward column web, an outboard forward column web and a transverse forward column web between the inboard forward column web and outboard forward column web, each rearward column including an inboard rearward column web, an outboard rearward column web, and a transverse rearward column web between the inboard rearward column web and outboard rearward column web, each side frame forward column and rearward column cooperating to define an opening in said side frame between the transverse forward column web and transverse rearward column web, each side frame further including an inboard forward lug on the inboard forward column web, an inboard rearward lug on the inboard rearward column web, an outboard forward lug on the outboard forward column web, and an outboard rearward column lug on the outboard rearward column web, each side frame lug having a stop surface;

said bolster having a first end, a second end, a forward side and a rearward side, each of said bolster ends matable with the opening in each side frame defined by the forward and rearward columns, said bolster further including a forward inboard bolster gib and a forward outboard bolster gib at said bolster forward side at each of said bolster first and second ends and a rearward inboard bolster gib and a rearward outboard bolster gib at said bolster rearward side at each of said bolster first and second ends, said forward inboard and outboard bolster gibs at each bolster end cooperating to define a clearance between said inboard and outboard bolster gibs greater than the width of the forward transverse column web of the side frame receiving the bolster end, said rearward inboard and outboard bolster gibs at each bolster end cooperating to define a clearance between said inboard and outboard bolster gibs greater than the width of the rearward transverse column web of the side frame receiving the bolster end, said forward and rearward inboard and outboard bolster gibs each having a stop surface;

said bolster having a bolster longitudinal axis corresponding with the railcar truck assembly transverse axis and generally normal to said railcar truck assembly longitudinal axis and said longitudinal axes of said side frames at a warp reference position;

angular displacement of said bolster longitudinal axis from the respective warp reference position defining a truck warp angle;

one inboard forward side frame lug and one inboard forward bolster gib at one end of the bolster defining an inboard forward neighboring bolster gib and side frame lug;

one inboard rearward side frame lug and one inboard rearward bolster gib at the same end of the bolster defining an inboard rearward neighboring bolster gib and side frame lug;

one outboard forward side frame lug and one outboard forward bolster gib at the same end of the bolster defining an outboard forward neighboring bolster gib and side frame lug;

one outboard rearward side frame lug and one outboard rearward bolster gib at the same end of the bolster defining an outboard rearward neighboring bolster gib and side frame lug;

at least part of the stop surfaces of each neighboring bolster gib and side frame lug being in facing relationship and in proximity to each other;

the inboard forward neighboring bolster gib and side frame lug and the outboard rearward neighboring bolster gib and side frame lug being diagonally opposite;

the inboard rearward neighboring bolster gib and side frame lug and the outboard forward neighboring bolster gib and side frame lug being diagonally opposite;

wherein at least a part of the stop surfaces of each neighboring bolster gib and side frame lug are sized, shaped and spaced so that at least one of the outboard neighboring bolster gibs and side frame lugs and the diagonally opposite inboard neighboring bolster gib and side frame lug at the same bolster end limit rotation of the bolster about a vertical axis to control the truck warp angle.

10. The three-piece railcar truck assembly of claim 9 wherein both outboard neighboring bolster gibs and side frame lugs at one end of the bolster and the diagonally opposite inboard neighboring bolster gib and side frame lug at the same end of the bolster limit rotation of the bolster about a vertical axis to control the truck warp angle.

11. The three-piece railcar truck assembly of claim 9 wherein the truck warp angle is limited to an angle of about 2° or less.

12. The three-piece railcar truck assembly of claim 9 wherein the truck warp angle is limited to an angle in the range of about 0.2°–2°.

13. The three-piece railcar truck assembly of claim 9 wherein the total of the distance between at least a part of the stop surfaces of the inboard forward neighboring side frame lug and bolster gib at one end of the bolster and the distance between at least a part of the stop surfaces of the inboard rearward neighboring side frame lug and bolster gib at the same end of the bolster is less than 3/32 inch; and the total of the distance between at least a part of the stop surfaces of the outboard forward neighboring side frame lug and bolster gib at one end of the bolster and the distance between at least a part of the stop surfaces of the outboard rearward neighboring side frame lug and bolster gib at the same end of the bolster is less than 3/32 inch.

14. A three-piece railcar truck assembly comprising a bolster and a pair of side frames, said three-piece railcar truck assembly having a longitudinal axis and a perpendicular transverse axis;

each said side frame having a longitudinal axis, a forward column and a rearward column, each forward column including an inboard forward column web, an outboard forward column web and a transverse forward column web between the inboard forward column web and outboard forward column web, each rearward column including an inboard rearward column web, an outboard rearward column web, and a transverse rearward column web between the inboard rearward column web and outboard rearward column web, each side frame forward column and rearward column cooperating to define an opening in said side frame between the transverse forward column web and transverse rearward column web, each side frame further including an inboard forward lug on the inboard forward column web, an inboard rearward lug on the inboard rearward column web, an outboard forward lug on the outboard forward column web, and an outboard rearward column lug on the outboard rearward column web, each side frame lug having a stop surface;

said bolster having a first end, a second end, a forward side and a rearward side, each of said bolster ends matable with the opening in each side frame defined by the forward and rearward columns, said bolster further including a forward inboard bolster gib and a forward outboard bolster gib at said bolster forward side at each said bolster first and second ends and a rearward inboard bolster gib and a rearward outboard bolster gib at said bolster rearward side at each said bolster first and second ends, each said forward inboard and outboard bolster gibs at each said bolster forward side cooperating to define a clearance between said inboard and outboard bolster gibs greater than the width of the forward transverse column web of the side frame receiving the bolster end, each said rearward inboard and outboard bolster gibs at each bolster rearward side cooperating to define a clearance between said inboard and outboard bolster gibs greater than the width of the rearward transverse column web of the side frame receiving the bolster end, said forward and rearward inboard and outboard bolster gibs each having a stop surface;

said bolster having a bolster longitudinal axis corresponding with the railcar truck assembly transverse axis and generally normal to said railcar truck assembly longitudinal axis and said longitudinal axes of said side frames at a warp reference position;

angular displacement of said bolster longitudinal axis from the warp reference position defining a truck warp angle;

one inboard forward side frame lug and one inboard forward bolster gib at one end of the bolster defining an inboard forward neighboring bolster gib and side frame lug;

one inboard rearward side frame lug and one inboard rearward bolster gib at the same end of the bolster defining an inboard rearward neighboring bolster gib and side frame lug;

one outboard forward side frame lug and one outboard forward bolster gib at the same end of the bolster defining an outboard forward neighboring bolster gib and side frame lug;

one outboard rearward side frame lug and one outboard rearward bolster gib at the same end of the bolster defining an outboard rearward neighboring bolster gib and side frame lug;

at least part of the stop surfaces of each neighboring bolster gib and side frame lug being in facing relationship and in proximity to each other;

the inboard forward neighboring bolster gib and side frame lug and the outboard rearward neighboring bolster gib and side frame lug being diagonally opposite;

the inboard rearward neighboring bolster gib and side frame lug and the outboard forward neighboring bolster gib and side frame lug being diagonally opposite;

wherein the outboard forward bolster gib and outboard rearward bolster gib at one end of the bolster and the neighboring outboard forward side frame lug and the neighboring outboard rearward side frame lug have outboard limits, and wherein the distances between the longitudinal centerline of the railcar truck assembly and said outboard limits of said side frame lugs are at least as great as the distances between the longitudinal centerline of said railcar truck assembly and said outboard bolster gibs at the warp reference position;

wherein the inboard forward bolster gib and inboard rearward bolster gib at one end of the bolster and the neighboring inboard forward side frame lug and the neighboring inboard rearward side frame lug have inboard limits, and wherein the distances between the longitudinal centerline of the railcar truck assembly and said inboard limits of said side frame lugs are no greater than the distances between the longitudinal centerline of the railcar truck assembly and the inboard limits of said inboard bolster gibs at the warp reference position;

wherein at least a part of the stop surfaces of each neighboring bolster gib and side frame lug are sized, shaped and spaced so that one of the outboard neighboring bolster gibs and side frame lugs and the diagonally opposite inboard neighboring bolster gib and side frame lug limit rotation of the bolster about a vertical axis to control the truck warp angle, and the truck warp angle is limited to an angle in the range of about 0.2°–2°.

15. The three-piece railcar truck assembly of claim 14 wherein the total of the distance between at least a part of the stop surfaces of the inboard forward neighboring side frame lug and bolster gib at one end of the bolster and the distance between at least a part of the stop surfaces of the inboard rearward neighboring side frame lug and bolster gib at the same end of the bolster is less than 3/32 inch; and the total of the distance between at least a part of the stop surfaces of the outboard forward neighboring side frame lug and bolster gib at one end of the bolster and the distance between at least a part of the stop surfaces of the outboard rearward neighboring side frame lug and bolster gib at the same end of the bolster is less than 3/32 inch.

16. The three-piece truck assembly of claim 15 wherein the distance between at least part of the stop surfaces of the outboard rearward neighboring side frame lug and bolster gib is in the range of 3/64–1/64 inches, the distance between at least part of the stop surfaces of the inboard forward neighboring side frame lug and bolster gib is in the range of 3/64–1/64 inches, the distance between at least part of the stop surfaces of the inboard rearward neighboring side frame lug and bolster gib is in the range of 3/64–1/64 inches, and the distance between at least part of the stop surfaces of the outboard forward neighboring side frame lug and bolster gib is in the range of 3/64–1/64 inches.

* * * * *